United States Patent [19]

Scherz

[11] 4,363,437

[45] Dec. 14, 1982

[54] WEB OF BAGS

[76] Inventor: Wilhelm Scherz, Bergwerkstr. 5, D 7180 Crailsheim, Fed. Rep. of Germany

[21] Appl. No.: 169,116

[22] PCT Filed: Feb. 22, 1979

[86] PCT No.: PCT/DE79/00021

§ 371 Date: Oct. 10, 1979

§ 102(e) Date: Oct. 10, 1979

[87] PCT Pub. No.: WO79/00655

PCT Pub. Date: Sep. 6, 1979

[30] Foreign Application Priority Data

Feb. 22, 1978 [DE] Fed. Rep. of Germany ..... 2807590
Jul. 4, 1978 [DE] Fed. Rep. of Germany ..... 2829364

[51] Int. Cl.[3] ..... B65D 27/10; B65D 30/00
[52] U.S. Cl. ..... 229/53; 206/390
[58] Field of Search ..... 229/69, 53; 206/390

[56] References Cited

U.S. PATENT DOCUMENTS 3,779,449 12/1973 Membrino ..... 229/69
4,021,283 5/1977 Weikert ..... 229/69

*Primary Examiner*—Stephen P. Garbe
*Attorney, Agent, or Firm*—Fred Philpitt

[57] ABSTRACT

There is indicated a web of bags comprising a carrying strip (20), on which individual bags (22) are fastened through discrete suspension sections (24). In the suspension sections (24), there are provided in the end that is to the rear in the direction of delivery during packaging notches (30) which extend to the edge of the suspension sections (24) and which facilitate the blowing-open of the bags (22) in an air curtain that is disposed substantially in the bag plane and is directed towards the filling aperture of the bag. For the very first lifting of the bag front wall, there may be provided in the bag rear wall, at the level of the end of the front wall of the bag, additional holes (18) through which a jet that is vertical on the bag plane can be directed towards the front wall of the bags.

To enlarge the transversal zone (W), within which the bags (22) can be separated from the carrying strip (20) by a cut extending in the longitudinal direction of the web, provision is made for the notches (30) to be provided with a substantially transversal section (30*a*) which extends from the interior end of the notches (30) transversally to the exterior.

16 Claims, 9 Drawing Figures

WEB OF BAGS

The invention relates to a web of bags according to the introductory part of claim 1 as well as to a method and a device for the production of such a web of bags.

In trade, there are obtainable webs of bags which are wound into rolls and where consecutive single bags are attached to a carrying strip. The bags are folded flat on the roll but can be opened and inflated, for the introduction of articles into the bags, by the application of an air flow. The air flow lies substantially in the delivery plane of the folded bags and is directed towards the bag edge which bounds the later filling aperture. The slit provided on the upper bag edge serves for allowing the bag to be blown up from the delivery plane into an oval or round shape. The latter is determined by guides on conventional machines for the packing of articles where use is made of webs of bags.

In practice, it has turned out that not all of the bags open properly when an air flow is applied to such a known web of bags; often up to 20% of the bags remain closed.

The invention therefore aims at providing a web of bags whose individual bags can be reliably opened by the application of an air flow. There is furthermore to be indicated a method for the production of such a web of bags and a device for the performance of such a method.

It has turned out in practice that on a web of bags where, according to the invention, the bags are provided with the slit at the rear edge, as viewed in the delivery direction during packing, the bags are opened and inflated with great reliability by the application of an air flow. This is presumably due to two reasons:

On the known webs of bags, the bag sections adjacent to the slits are pushed and are braked by frictional forces which are brought about by the machine guide supporting the bags. This involves the risk of these bag sections being turned over. The bag will then be folded exactly at that portion of the filling aperture where it is meant to be opened by the air flow. By contrast, on the web of bags according to the invention, the bag sections adjacent to the slits are dragged. They are thus drawn outwardly in the desired manner by the friction prevailing on the respective guides of the packing machine; a bag section adjacent to the slit and initially turned over is even turned back again.

In the very first inflation phase, a portion of the bag rear wall section adjacent to the slit is initially increasingly pressed against the machine guide, which is located therebehind, by the onflowing air. On the known web of bags, where this section of the bag rear wall is pushed under friction, this leads to a force counteracting the opening movement. On the web of bags according to the invention, where the corresponding wall section is drawn, such a force inhibiting the opening of the bag does not arise.

Advantageous further developments of the invention are indicated in further claims.

On a web of bags according to the invention, the individual bags can be cut off within a range of tolerance of the same thickness of material. In a further development of the invention, the dimensions of this range of tolerance are specified by the dimensions of the interspaces, and in a further development of the invention, they are specified by the dimensions of the additional notch.

On a web of bags according to the invention, the opening of the bag can be ensured, even under very unfavourable conditions, in that a jet of air which is vertical to the delivery plane passes through the hole in a bag onto the bag front wall and thereby lifts this latter from the rear wall.

If, according to the invention, the hole is provided at the end of the slits, then it can be produced together with these in a simple manner and simultaneously bounds the slits so that these are not torn to any further extent under tensile forces, since no slit effect is provided at the end of the slits.

A web of bags according to the invention has a single-layer carrying strip. On the known webs of bags, the carrying strip consists of two heat-sealed layers. However, the heat-sealing of these two layers necessitates an additional expenditure; and yet, under unfavourable transporting conditions, they may be displaced relative to each other, which leads to irregularities in the operation of the packing machine.

A double web of bags according to the invention can be particularly easily wound into a roll since it has the same thickness over the entire width and is continuous. At the place of use, the double web of bags can be easily divided into two separate webs of bags by mechanical forces.

The further development according to the invention ensures that a slightly loadable bond between the two webs of bags is maintained but that the two webs of bags can also be easily separated.

If the individual bags of webs of bags are not cut off in the packing machine exactly at the level of the slits extending in the longitudinal direction of the web, then it may occur, particularly in the case of bags filled with heavy goods, that towards the end of the cutting-off operation the bags are still connected to the carrying strip through a narrow strip of material which is formed by the sheeting section located between the cutting line and the slit. For many cases of application this has no disturbing effect, but trouble with respect to the guidance of the carrying strip and the bags may arise, particularly when heavy goods are packed and high speeds are operated.

The further development of a web of bags according to the invention is such that even if the cutting line is not exactly aligned with the slits, a satisfactory separation of the bags and a trouble-free guidance of the carrying strip is obtained, even if the web of bags is being filled with fairly heavy goods or runs at a high speed.

The satisfactory separation of the bags is thus brought about during the production of the web of bags without any additional expenditure since, as regards cost, it makes no difference whether the slit, which is produced by revolving knives or by separation heat-sealing and which promotes the blowing-open of the bags, is additionally provided with an angled section extending substantially transversally to the longitudinal direction of the web.

On the web of bags according to the invention, all the bags are cut off in like manner, irrespective of the respective transversal position of the cutting line within a specified cutting zone, when the cutting line reaches the associated transversal section of the slit promoting the blowing-open. With the alignment of their longitudinal axis used as a rule during packaging, the bags then drop under exactly reproduceable conditions, more especially with a specified orientation. This orientation is closer in the original orientation of the bags in the web of bags than in a web of bags without the angled section 30*a*.

With the further development of the invention according to the invention there is obtained a particularly wide cutting zone, within which the transversal position of the knife used for cutting the bags off may vary without affecting the cutting-off of the bags.

The further development of the invention according to the invention ensures that during the cutting-off of the individual bags there are not obtained in the packing machine, in addition to the carrying strip now wound up again in a roll and to the separated bags, any sheeting sections which would have to be removed separately.

The method according to the invention allows webs of bags to be produced where the individual bags follow one another at a short distance and are shut at the bottom.

If the notches are produced by using cutting knives, in accordance with the invention, then it is ensured that the filling aperture of the bags will reliably open when an air flow is applied thereto.

The further development of the invention according to the invention ensures that the slit extends in any event as far as the rear edge of a bag. For if a bridge is left at the rearmost point of a slit, then the bag cannot bulge out from the delivery plane, in the same way as if no slit were provided at all.

The method according to the invention is suitable for the easy production of a double web of bags, the sheeting web edge sections which project beyond the overlapping zone forming carrying sections for a completed web of bags.

The double web of bags obtained according to the method of the invention can either be put on the market as such or can be broken, according to the invention, along the separation heat-seals and be divided into two single webs of bags.

A device as indicated in the drawing requires only a single control means for the cutting units, which produce the slits in the internested sets of bags.

A device as claimed in the invention is particularly well suited for a continuous production of a web of bags.

The further development of the invention according to the invention ensures that the two simultaneously produced webs of the bags are separated by forces acting vertically to the common delivery plane without the exertion of any appreciable tensile loads on the bags themselves, which might cause the bags, which are made of very thin sheeting, to become distorted. Another advantage of the device according to the invention is to the effect that after the breakage of the predetermined separation points the two webs of bags are also obtained separately in space.

Hereinafter, the invention will be explained in more detail by means of some exemplified embodiments and with reference to the accompanying drawings, in which.

Figure 1:
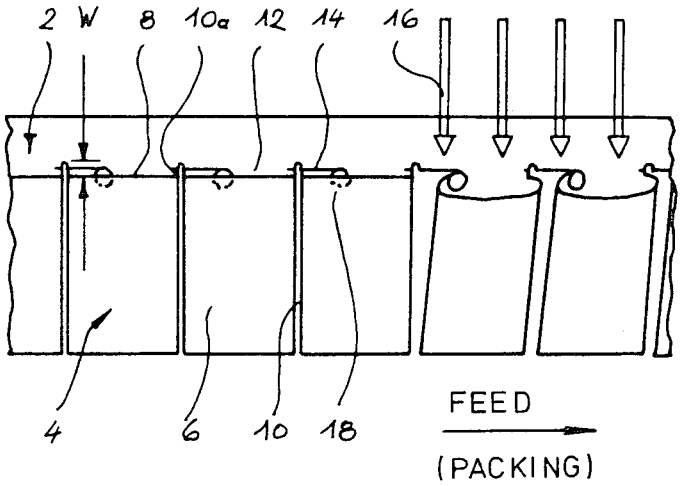
FIG. 1 shows a top view of a section of a first web of bags comprising closed bags which follow one another closely.

FIG. 1 shows an endless web of bags consisting of a carrying strip 2 and consecutive bags 4, whose rear wall is integrally formed with the single-layer carrying strip. The front wall 6 of the individual bags ends in an upper edge 8 which bounds the later filling aperture of the bag. The bags 4 are divided by separation heat-seals 10 which end, in a section 10*a*, a specified distance beyond the upper edge 8 of the bags. In this way, there is obtained on each bag a cutting zone 12 having the width W, as indicated in the drawing, within which zone the cutting of the bags can be effected at any point by a cutting means of the packaging machine not shown. Like the carrying strip itself, the cutting zone consists of a single layer so that constant good cutting conditions are provided when the individual bags are cut from the carrying strip.

In the portion of the cutting zones 12 that is to the rear as viewed in the direction of delivery during packaging, there are provided slits 14 which extend horizontally over approximately one third of the bag width and slightly go beyond the following separation heat-seal 10. This ensures that upon the application from the top of an air flow 16, which lies substantially in the delivery plane predetermined by the bags, the upper edge of the bags can open and can assume an oval shape or the shape of a flattened circle, as is indicated in the right-hand portion of FIG. 1.

For particularly unfavourable flow application conditions, e.g. when long and narrow bags are used or when webs of bags are used which are made of sheets having good adhesion properties, there is additionally provided in the rear wall of the bags a hole 18, through which a sharp jet of air not shown can be directed from the bag rear on the front wall of the bags, causing this wall to be lifted to some extent and thus to offer a larger surface of application to the air flow 16 disposed in the bag plane. In this way, it is easier for the air flow 16 to open the bag fully. The holes 18 are preferably provided at the inwardly located end of the slits 14, that is to say in a central section of the upper edge 8.

The web of bags shown in FIG. 1 can be produced as follows:

The slits 14 and the holes 18 are cut into a sheeting web, whose width is equal to that of the carrying strip plus twice the depth of the bags, with the aid of cam-operated punching dies. Then, the lower web section is folded upwards for the formation of the bag front wall and the separation heat-seams 10 are produced so that they extend beyond the upper edge of the front wall 6 by the distance W, which may be effected, for example, by means of a heat-sealing drum having heat-sealing ribs of corresponding length. Then, the external ends of the notches 14, over which the separation heat-seals have been taken, are broken up again, so as to be on the safe side, which may be effected by the co-operation of the rollers having a complementary V-shaped profile. If there is no requirement for holes 18, the slits 14 are not produced until after the production of the separation heat-seals, which ensures that the rear ends of the sections 14 are completely open. It is also possible first to punch the holes 18, then to provide the separation heat-seals 10 and finally to produce the slits 14.

The web of bags thus produced has bags which are closed towards the bottom and which are suitable, for example, for the filling of loose materials.

Figure 2:
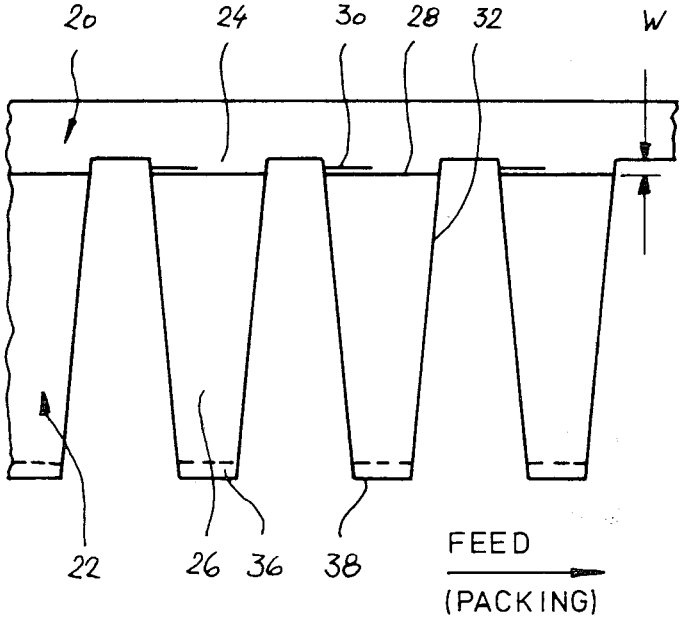
FIG. 2 shows a view of a section of a second web of bags comprising bags which follow one another at intervals and are open at the bottom and are intended for the packaging of flowers.

FIG. 2 shows a web of bags which is suitable for packaging flowers and comprises a carrying strip 20 and bags 22 which follow one another at intervals. The bag rear wall is integrally formed with the single-layer carrying strip 20 through projecting discrete suspension sections 24. The width of the latter perpendicularly to the web longitudinal axis is again designated W. In this way, the cutting of the bags from the carrying strip can again be effected in the single-layer material within a range of tolerance. The front wall 26 again ends in an upper edge 28 which bounds the filling aperture of the bags. Slits 30 are provided at the rear end of the discrete suspension sections 24. Separation heat-seals 32 are inclined with respect to the web longitudinal direction so that the individual bags have a frusto-conical shape when they have been blown open. The bags are open at the bottom, the lower edge 36 of the rear wall of the bag extending beyond the bottom edge 38 of the bag front wall by the distance W.

Figure 3:
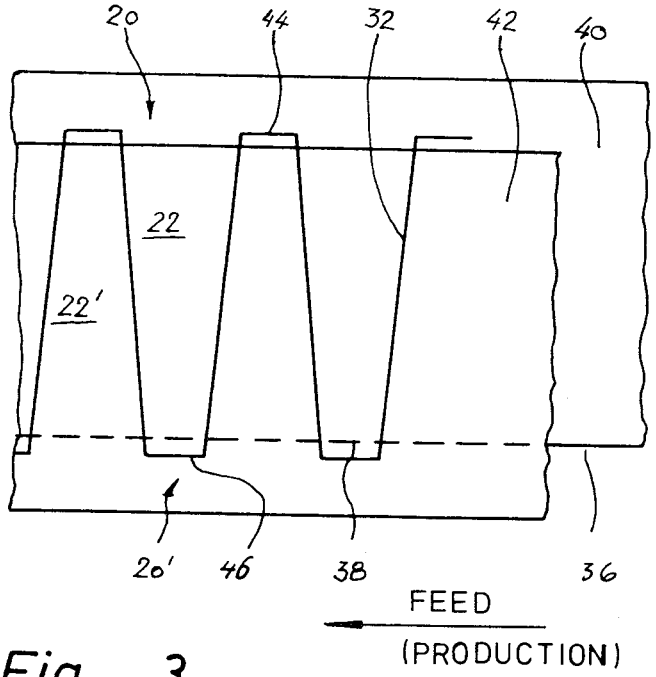
FIG. 3 shows a first production section of the web of bags shown in FIG. 2.

The production of the web of bags shown in FIG. 2 will now be described with reference to FIGS. 3 and 4.

Two polyethylene or PVC sheeting webs of equal width and having a thickness of approximately $2\mu$ (maximum thickness $50\mu$) are joined being staggered by the width of the carrying strip. Thereafter, the separation heat-seals 32 are effected, which partly comprise sections 44 and 46 passing through single-layer material. For the sake of providing a better understanding and for a better correlation with FIG. 2, the direction of delivery for the production of a bag web supply roll is shown to be opposite to the direction of delivery for packaging. It is, of course, possible for the direction of delivery during production to be the same as that during packaging, particularly if it is desired to couple a machine for the production of a web of bags directly with a packaging machine, the web of bags then not being wound into a roll for some time.

During the production of a roll of a web of bags shown in the drawing, the slits 30 are thus produced in the front of the suspension sections 24, as viewed in the direction of delivery used during production. When the web of bags is wound from the roll, they then lie in the rear portion of the suspension sections 24, as viewed in the direction of delivery used during packaging. The slits 30 again extend somewhat beyond the adjacent separation heat-seal.

The still coherent double web of bags thus obtained, wherein identical parts are provided with identical reference symbols, which are however provided with a comma, can be put on the market as such, in order to be broken up later at the place of use along the separation heat-seals into two webs of bags and then to supply simultaneously two packaging machines. However, it is also possible to pull the double web of bags apart already during its production and to wind it into two separate supply rolls.

Figure 4:
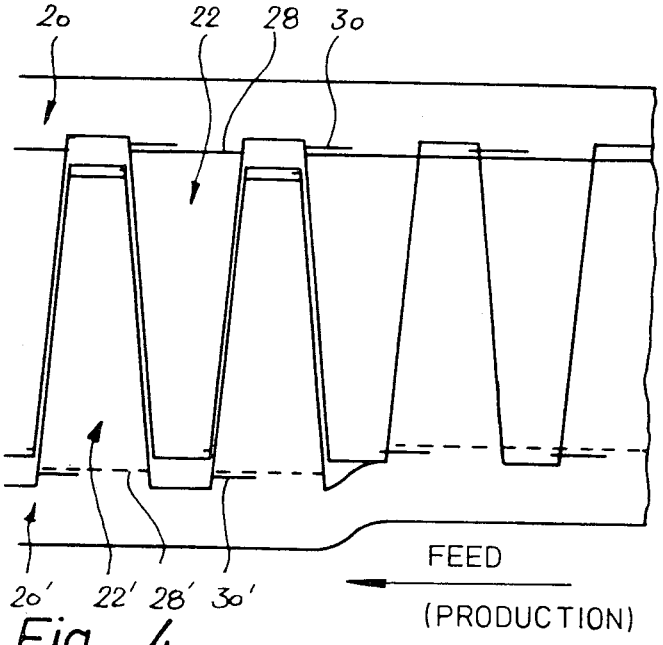
FIG. 4 shows a second production section of the web of bags shown in FIG. 2.
Figure 5:
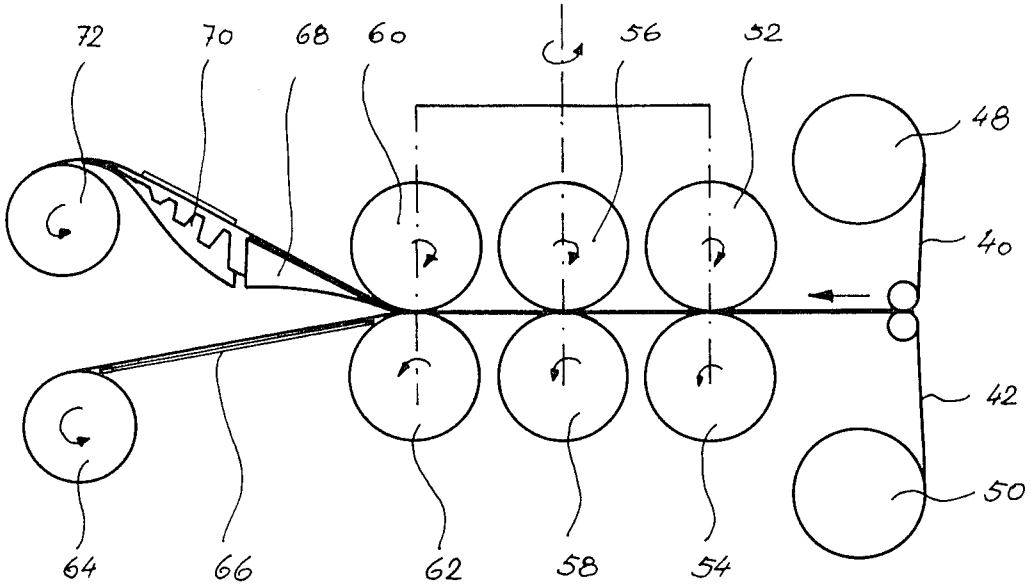
FIG. 5 shows a diagrammatical view of a machine for the production of the web of bags shown in FIG. 2.

FIG. 5 diagrammatically shows a machine for the production of two separate webs of bags, starting out from two plastics material sheets according to the method described above with reference to FIGS. 3 and 4.

The two webs of sheeting 40, 42 are drawn from two supply rolls 48, 50 which are already staggered by the width of the carrying strip. The two webs of sheeting then run jointly into the gap between a heat-sealing drum 52 and a counter drum 54 which is coated with thermostable rubber. The webs of sheeting, which have been heat-sealed in a line-like manner, then pass through a cutting drum 56 and a counter drum 58 associated with this latter. The cutting drum 56 is provided with knives at the points associated with the slits 30 and its counter drum is provided with corresponding counter knives.

The webs of sheeting, which have been heat-sealed and provided with slits, then pass through a pair of separating drums 60, 62 which pull the two webs of bags apart by applying a force that is directed vertically to the web of sheeting. This occurs in such a way that the web of bags that lies on top in FIG. 4 is pressed downwards. This web of bags is then deflected further in the downward direction and is wound into the bag web roll 64 in a substantially unchanged orientation. The bags are supported during this process by a carrying plate 66.

The web of bags lying at the bottom in FIG. 4 is pulled in the upward direction, the bags being initially supported by a helical carrying plate. All the bags slide upwardly thereon, the bag ends being however increasingly lowered with respect to the associated carrying strip section. At the point where the bags of the upwardly drawn web of bags can no longer come into contact with the lower web of bags, the carrying plate 68 ends and the bags are lifted in the same sense of rotation as during the previous lowering by another helical carrying plate 70, the carrying strip itself being crossed accordingly. At the end of the carrying plate 70, the bags of the upwardly drawn web of bags are aligned exactly like those of the downwardly drawn web of bags; however, as viewed from the top, they are laterally offset by substantially the width of the web of bags. The upwardly drawn web of bags is wound into a bag web roll 72 that is laterally offset with respect to the lower bag web roll 64.

Figure 6:
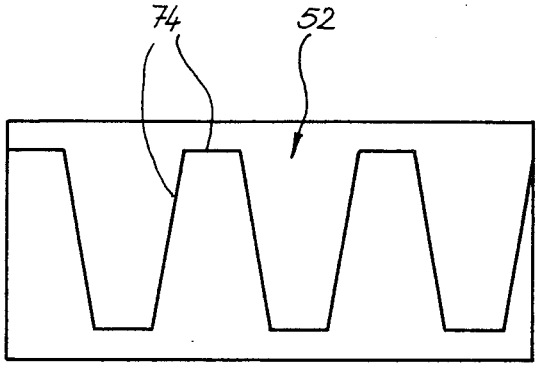
FIG. 6 shows a development of the outer surface of a heat-sealing drum of the machine shown in FIG. 5.

FIG. 6 shows a development of the outer surface of the heat-sealing drum 52. There are discernible sealing ribs 74 which are superimposed on the outer surface. These may be, for example, bars which are inserted in the drum body and are provided with sealing edges and are electrically heated.

Figure 7:
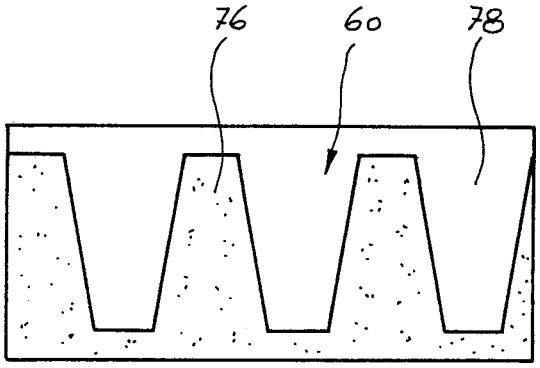
FIG. 7 shows a development of the outer surface of a separating drum of the machine shown in FIG. 5.

FIG. 7 shows the development of the outer surface of one of the separating drums, projecting outer surface sections 76 being shown as dots, whereas the outer surface sections 78 jutting out backwards are not specially marked. The other separating drum is of exactly complementary shape and engages in the first separating drum in a gear-like manner. In this way, the double web of bags is so heavily loaded along the separation heat-seals vertically to the web plane, as it passes through the separating drums, that the separation heat-seals break. The two webs of bags obtained thus run out of the pair of separating drums at different levels.

As is symbolically shown by broken lines in the drawing, the heat-sealing drum, the cutting drum and the separating drum as well as the counter drums associated with these are synchronously driven from a common drive. The pre-set phase difference in the angular position of the various drums corresponds to their centre-to-centre distance, as viewed in the direction of delivery during production, divided by the drum radius.

Figure 8:
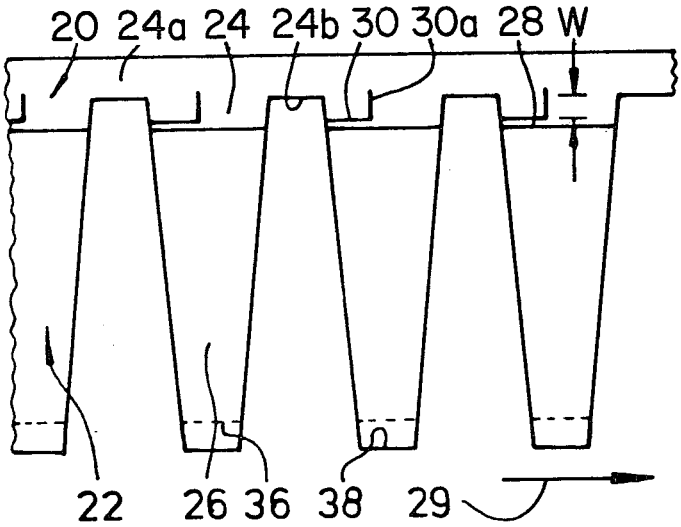
FIG. 8 shows a first constructional form of a plastic film web of bags wherein the slits promoting the blowing-up of the bags are additionally provided with a transversal section.
Figure 9:
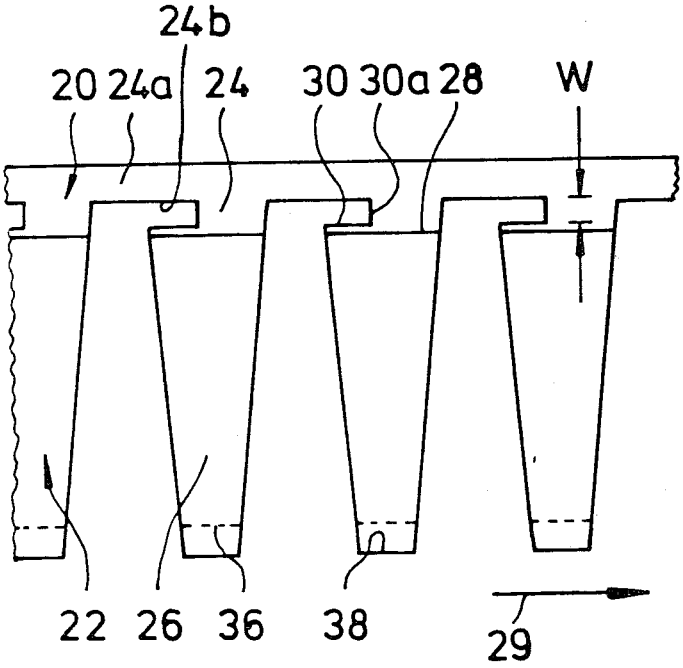
FIG. 9 shows a web of bags similar to that shown in FIG. 8, wherein the film portions located behind the transversal notches in the packaging direction have however been removed.

FIGS. 8 and 9 show modified webs of bags, wherein the slits 30 are additionally provided with a transversal section. In these exemplified embodiments, parts which equal those described above with reference to FIGS. 2 to 4 are provided with the same reference symbols.

FIG. 8 shows a web of bags suitable for the packaging of flowers and provided with a carrying strip 20 and bags 22 following one another at intervals. The bag rear wall is integrally formed with the single-layer carrying strip 20 through transversally projecting discrete suspension sections 24. Between these suspension sections 24, there are located carrying strip sections 24*a*, whose width is reduced and whose edge that is the lower one in the drawing is designated 24*b*.

A front wall 26 of the bags 22 ends in an upper edge 28 which bounds the filling aperture of the bags. The direction in which the web of bags is moved during packaging is indicated by an arrow 29 in the drawing. In the ends of the discrete suspension sections 24 which are to the rear with respect to the direction of delivery during packaging, there are provided slits 30 which facilitate the blowing-open of the bags when an air flow, which extends transversally to the longitudinal direction of the web and is directed from top to bottom in the drawing, is applied thereto. Lateral edges of the bags formed by separation heat-seals 32 are inclined relative to the longitudinal direction of the web, so that the individual bags have a frusto-conical shape after having been blown open. The bags are open at the bottom, the lower edge 36 of the bag rear wall being above the lower edge 38 of the bag front wall by a distance which is equal to the distance of the upper edge 28 of the front wall 26 from the edges 24*b*.

The slits 30 have at the end that is adjacent to the centre of the bags an adjoining section 30*a* which extends in the transversal direction to the free edge of the carrying strip 20, that is to say upwardly in the drawing, and which lies somewhat above a straight line connecting the edges 24*b*.

In the drawing, the transversal distance between the edges 24*b* of the carrying strip sections 24*a*, whose width is reduced, and the slits 30 is designated W. Within the thus predetermined cutting zone, the knife used for the separation of the bags can be disposed in any desired transversal position without this affecting the point in time at which the bags are separated or the orientation at which the bags come clear of the carrying strip. There is thus no need to adjust the web of bags precisely with respect to the knife. On a web of bags normally used for the packaging of flowers, the bags have approximately a height of 40 cm, the distance W is approximately 20 mm and the width of the narrow carrying strip sections 24*a* is also approximately 20 mm.

The constructional form of a web of bags shown in FIG. 9 is almost completely identical with that shown in FIG. 8. The only difference is that the edges 24*b* extend as far as the upper end of the sections 30*a* of the slits 30. In this way, there are not obtained any small sheeting sections when the bags 22 are cut off, as is the case in the exemplified embodiment shown in FIG. 8, if there is simultaneously separated by the knife a portion of the sheeting tab bounded by the slit 30 and the section 30*a* adjoining it.

In practice, the webs of bags shown in FIGS. 1 and 2 and having the dimensions indicated above allow good operating conditions at a speed of 12 m/min. The construction of the web of bags makes it possible to reach speeds of 30 to 40 m/min, but such high packaging speeds are as a rule not required for the manual filling of the bags with a commodity.

I claim:

1. In a web of bags comprising (a) an elongated continuous carrying strip, (b) a plurality of parallel spaced apart consecutive bags suspended therefrom, each bag having an upper opening, and (c) a plurality of spaced apart slits located above the upper openings of said bags, said slits extending along a line which is parallel to the longitudinal direction of movement of said carrying strip, the improvement which comprises only one slit extending above each bag, each slit being located near the rear edge of each bag when viewed in the direction of travel of the carrying strip, and each bag is open at the bottom, whereby, as said web of bags passes under a downwardly directed air stream each bag will in turn be opened by said air stream and each bag will be rolled forwardly about its axis a limited amount under the influence of the inflating air stream.

2. A web of bags as set forth in claim 1 wherein each of the bags comprises a front and rear wall and the single slit associated with each bag is provided in a suspension section which is an extension of the rear bag wall and which projects downwardly from the continuous carrying strip.

3. A web of bags as set forth in claim 1 or 2 wherein interspaces are located between adjacent suspension sections.

4. A web of bags according to claim 1 wherein each of the bags is connected to the carrying strip through a suspension section which is an extension of the rear wall of the bag and interspaces are located between adjacent suspension sections.

5. A web of bags as set forth in claim 1 or 4 characterized in that the carrying strip is a single layer extension of the rear bag wall.

6. A web of bags as set forth in claim 1 or 4 which includes two carrying strips which are disposed opposite to each other as seen in transversal direction of the web and which each carry a set of bags, the two set of bags engaging in one another in a comb-like manner, and in that the carrying strips and the two sets of bags are held together to form a single web through selected separating points.

7. A web of bags according to claim 1 or 4 wherein each of said slits also includes a transverse section which extends in a direction transverse to the direction of movement of said carrying strip.

8. A web of bags as set forth in claim 7 characterized in that said carrying strip has sections of reduced width being disposed between the bags and in that the ends of said transverse sections of said slits are substantially aligned with edges bounding the narrower sections of the carrying strip or slightly extending therebeyond.

9. A web of bags as set forth in claim 8 characterized in that the edges bounding the narrower sections of the carrying strip extend as far as the transverse sections of the notches.

10. A web of bags as claimed in claim 1 characterized in that holes (18) are located at the end of the slits (14).

11. A web of bags as claimed in claim 1, characterised in that it comprises two carrying strips (20; 20') which are opposite to each other in the transversal direction and which carry bags (22; 22') which engage in one another in a comb-like manner and in that the carrying strips and the bags of the two sets are held together in a web through predetermined separating points (32).

12. A web of bags as claimed in claim 11, characterised in that it consists of a heat-sealable plastics material and in that the predetermined separating points are separation heat-seals (32).

13. A web of bags as claimed in claim 1, characterised in that the slits (30) have a section (30*a*) extending in the substantially transversal direction of the free edge of the carrying strip (20).

14. A web of bags as claimed in claim 13, wherein the carrying strip has sections, which are disposed between the bags, of reduced width, characterised in that the ends of the transversal sections (30*a*) of the notches (30) are substantially aligned with the edges (24*b*) bounding the narrower carrying strip sections (24*a*) or slightly extend beyond these.

15. A web of bags as claimed in claim 14, characterised in that the edges (24*b*) bounding the narrower carrying strip sections (24*a*) extend as far as the transversal sections (30*a*) of the notches (30).

16. A web of bags as claimed in claim 1, characterised by a least one hole (18) formed in the rear walls of the bags (4).

* * * * *